US010982640B2

(12) United States Patent
Gargiulo et al.

(10) Patent No.: US 10,982,640 B2
(45) Date of Patent: Apr. 20, 2021

(54) INJECTION VALVE WITH A MAGNETIC RING ELEMENT

(71) Applicant: Continental Automotive GmbH, Hannover (DE)

(72) Inventors: Luigi Gargiulo, Pisa (IT); Antonio Agresta, Pisa (IT); Marco Mechi, Vada (IT)

(73) Assignee: VITESCO TECHNOLOGIES GMBH, Hanover (DE)

( * ) Notice: Subject to any disclaimer, the term of this patent is extended or adjusted under 35 U.S.C. 154(b) by 303 days.

(21) Appl. No.: 16/313,220

(22) PCT Filed: Jun. 29, 2017

(86) PCT No.: PCT/EP2017/066110
§ 371 (c)(1),
(2) Date: Dec. 26, 2018

(87) PCT Pub. No.: WO2018/002209
PCT Pub. Date: Jan. 4, 2018

(65) Prior Publication Data

US 2020/0309077 A1 Oct. 1, 2020

(30) Foreign Application Priority Data

Jun. 30, 2016 (EP) ..... 16177113

(51) Int. Cl.
*F02M 61/20* (2006.01)
*F02M 51/06* (2006.01)

(52) U.S. Cl.
CPC ..... *F02M 61/20* (2013.01); *F02M 51/0664* (2013.01); *F02M 51/0685* (2013.01)

(58) Field of Classification Search
CPC ..... F02M 51/066; F02M 51/0664; F02M 51/0685; F02M 61/20; F02M 61/205; F02M 2200/50
See application file for complete search history.

(56) References Cited

U.S. PATENT DOCUMENTS 9,359,984 B2 * 6/2016 Lyubar ..... F02M 51/0625
9,435,305 B2 * 9/2016 Mechi ..... F02M 51/0685
(Continued)

FOREIGN PATENT DOCUMENTS

CN 105508082 A 4/1916 ..... F02D 19/02
CN 205206900 U 5/1916 ..... F01L 1/344
(Continued)

OTHER PUBLICATIONS

Korean Notice of Allowance, Application No. 20197003011, 3 pages, dated Apr. 28, 2020.
(Continued)

*Primary Examiner* — Darren W Gorman
(74) *Attorney, Agent, or Firm* — Slayden Grubert Beard PLLC

(57) ABSTRACT

An injection valve may include: a valve needle moving from a closed position to an open position; a calibration spring biasing the needle towards the closed position; an armature moving toward the pole piece to take the valve needle towards the open position with respect to the valve needle; and a pole piece. Some valves include a magnetic ring moving between a first position, with a top side spaced apart from the pole piece and an underside in contact with the valve needle, and a second position where the top side is in contact with the pole piece. A second spring is in parallel to the calibration spring. An upper retaining element connected to a shaft extends in radial direction to limit movement of the armature relative to the valve needle so that the armature
(Continued)

connects to the upper retaining element to displace the valve needle towards the open position.

11 Claims, 3 Drawing Sheets

(56) References Cited

U.S. PATENT DOCUMENTS

| | | | | |
|---|---|---|---|---|
| 9,903,327 | B2 * | 2/2018 | Izzo | F02M 51/0614 |
| 9,995,262 | B2 * | 6/2018 | Grandi | F02M 51/066 |
| 2013/0181795 | A1 | 7/2013 | Mitsumata et al. | 335/281 |
| 2013/0221138 | A1 | 8/2013 | Rogler | 239/585.5 |
| 2016/0097358 | A1 * | 4/2016 | Miyake | F02M 63/0075 239/585.1 |
| 2017/0241389 | A1 * | 8/2017 | Yasukawa | F02M 51/0685 |
| 2017/0260952 | A1 * | 9/2017 | Nakai | F02M 61/168 |

FOREIGN PATENT DOCUMENTS

| | | | | |
|---|---|---|---|---|
| CN | 2597787 | Y | 1/2004 | F16K 11/074 |
| CN | 201819613 | U | 5/2011 | B03C 1/005 |
| CN | 103206571 | A | 7/2013 | F16K 31/06 |
| CN | 103574090 | A | 2/2014 | F16K 27/00 |
| DE | 103 32 812 | A1 | 2/2005 | F02M 51/06 |
| EP | 2 333 297 | A1 | 6/2011 | F02M 51/06 |
| EP | 2436910 | A1 | 4/2012 | F02M 51/06 |
| EP | 2 634 412 | A1 | 9/2013 | F02M 51/06 |
| EP | 2 896 813 | A1 | 7/2015 | F02M 51/06 |
| EP | 2 985 445 | A1 | 2/2016 | F02M 51/06 |
| JP | 2006-258074 | A | 9/2006 | F02M 51/06 |
| JP | 2012-172594 | A | 9/2012 | F02M 51/06 |
| JP | 2015-121188 | A | 7/2015 | F02M 51/06 |
| WO | 2018/002209 | A1 | 1/2018 | F02M 51/06 |

OTHER PUBLICATIONS

Chinese Office Action, Application No. 201780040886.4, 6 pages, dated May 12, 2020.

Extended European Search Report, Application No. 16 177 113, 7 pages, dated Jan. 9, 2017.

International Search Report and Written Opinion, Application No. PCT/EP2017/066110, 11 pages, dated Oct. 4, 2017.

* cited by examiner

INJECTION VALVE WITH A MAGNETIC RING ELEMENT

CROSS-REFERENCE TO RELATED APPLICATIONS

This application is a U.S. National Stage Application of International Application No. PCT/EP2017/066110 filed Jun. 29, 2017, which designates the United States of America, and claims priority to EP Application No. 16177113.4 filed Jun. 30, 2016, the contents of which are hereby incorporated by reference in their entirety.

TECHNICAL FIELD

The present disclosure relates to internal combustion engines. Various embodiments may include an injection valve, e.g. a fuel injection valve of a vehicle, including solenoid injection valves.

BACKGROUND

Typically, injection valves are so-called "normally closed valves" and have a valve needle biased towards a closing position by a calibration spring. A fundamental problem with such injection valves is that during the closing phase a high calibration spring preload is desirable, because it leads to a faster closing and better injector dynamic behavior, while at the same time a high calibration spring preload leads to a decreased injector maximum opening pressure. Hence, the spring preload has always been a compromise between behavior during opening and closing phase and maximum opening pressure of the injector. In case of high fuel pressure, the problem is particularly prominent since high spring rates of the calibration spring are required.

DE 10332812 A1 discloses a fuel injection valve that has a magnetic coil which cooperates with an armature which is acted upon by a return spring. An additional mass is located in the recess of the armature. The additional mass hits the armature with predetermined acceleration after an additional lift. The additional mass is acted upon by a spring in the closure direction of the fuel injection valve.

SUMMARY

The teachings of the present disclosure may include an injection valve that overcomes the above mentioned difficulties and which provides a stable performance even under conditions of high fluid pressure. For example, some embodiments include an injection valve (1) comprising a valve assembly (2) and an electro-magnetic actuator unit (19), the valve assembly (2) comprising: a valve body (4) comprising a cavity (9) with a fluid inlet portion (5) and a fluid outlet portion (7), a valve needle (11) axially moveable in the cavity (9), the valve needle (11) preventing a fluid flow through the fluid outlet portion (7) in a closing position and releasing the fluid flow through the fluid outlet portion (7) in at least one opening position, a calibration spring (18) for axially biasing the valve needle (11) towards the closing position; the electro-magnetic actuator unit (19) comprising an armature (23) axially movable in the cavity (9) and a pole piece (25), towards which the armature (23) is movable to take the valve needle (11) towards the at least one opening position; the injection valve (1) further comprising a further spring element (27) and a magnetic ring element (28), the further spring element (28) being arranged in parallel to the calibration spring (18) and preloading the magnetic ring element (28), wherein the magnetic ring element (28) is axially movable in the cavity (9) between a first position, in which a top side (38) of the magnetic ring element (28) is axially spaced apart from the pole piece (25) and an underside (36) of the magnetic ring element (28), opposite of the top side (38), is in contact with the valve needle (11), and a second position, in which a top side (38) of the magnetic ring element (28), opposite of the underside (36), is in contact with the pole piece (25), wherein the armature (23) is axially movable with respect to the valve needle (11), the valve needle (11) comprising an upper retaining element (24) fixedly connected to a shaft of the valve needle (11) and extending in radial direction and being arranged in an axial region of the valve needle (11) facing away from the fluid outlet portion (7), the upper retaining element (24) limiting the movement of the armature (23) relative to the valve needle (11) so that the armature is operable to engage in form-fit connection with the upper retaining element (24) for displacing the valve needle (11) towards the at least one opening position.

In some embodiments, the magnetic ring element (28) and the electro-magnetic actuator unit (19) are configured and arranged to move the ring element (28) out of contact with the valve needle (11) when the electro-magnetic actuator unit (19) is activated to move the valve needle (11) towards the at least one opening position.

In some embodiments, the magnetic ring element (28) is unobstructedly displaceable in reciprocating fashion between the valve needle (11) and the pole piece (25).

In some embodiments, the magnetic ring element (28) is spaced apart from the armature (23).

In some embodiments, the further spring element (27) is more strongly compressed by the magnetic ring element (28) in its second position than by the magnetic ring element (28) in its first position.

In some embodiments, the further spring element (27) and the magnetic ring element (28) are configured and arranged such that the magnetic ring element (28) compresses the further spring element (27) at least partially before an opening force of the valve assembly (2) becomes larger than a needle closing force.

In some embodiments, the further spring element (27) is a wave spring.

In some embodiments, the pole piece (25) comprises an upper recess (32), in which the further spring element (27) is retained, and a lower recess (34), in which the magnetic ring element (28) is retained, the lower recess (34) being arranged between the upper recess (32) and the armature (23).

In some embodiments, the further spring element (27) is arranged coaxially with the calibration spring (18).

In some embodiments, when the magnetic ring element (28) is in the first position, the underside (36) of the magnetic ring element (28) is in contact with the upper retaining element (24) on a side of the upper retaining element (24) facing away from the armature (23).

In some embodiments, the magnetic ring element (28) is made of ferromagnetic steel.

BRIEF DESCRIPTION OF THE DRAWINGS

Further advantages, embodiments, and developments of the teachings herein are apparent from the example embodiments described below in association with schematic figures.

DETAILED DESCRIPTION

Figure 1:
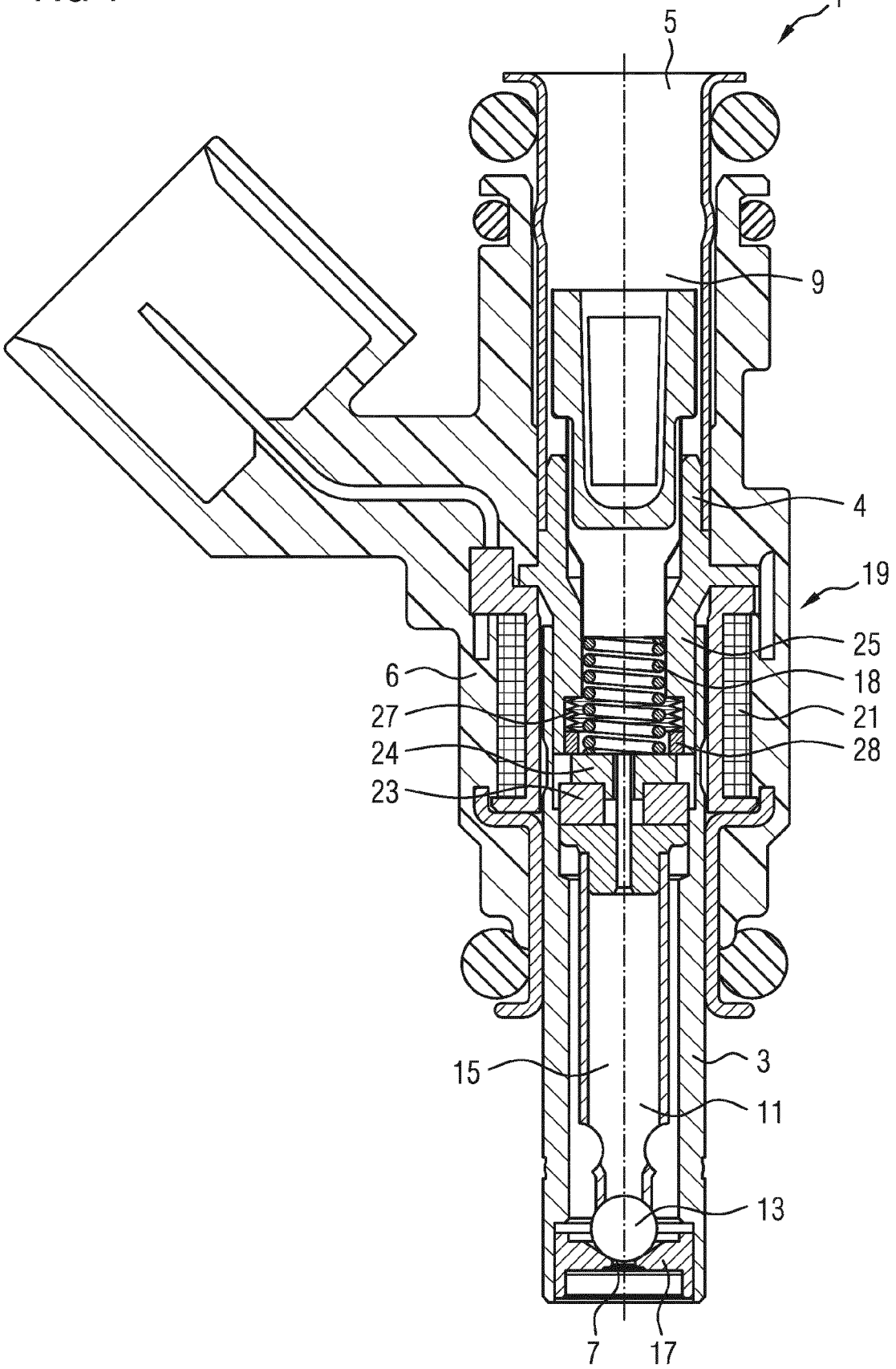
FIG. 1 shows a longitudinal sectional view of an injection valve with a valve assembly incorporating teachings of the present disclosure.

Some embodiments include an injection valve comprising a valve assembly and an electro-magnetic actuator unit. For example, the valve assembly may comprise a valve body comprising a cavity with a fluid inlet portion and a fluid outlet portion and a valve needle axially moveable in the cavity. Specifically, the valve needle is axially displaceable relative to the valve body in reciprocating fashion. The valve needle prevents a fluid flow through the fluid outlet portion in a closing position and releases the fluid flow through the fluid outlet portion in at least one opening position. Further, the valve assembly comprises a calibration spring for axially biasing the valve needle towards the closing position.

The electro-magnetic actuator unit is configured and arranged to actuate the valve needle. The electro-magnetic actuator unit comprises an armature axially movable in the cavity, in particular positioned in the cavity and axially displaceable relative to the valve body in reciprocating fashion. In some embodiments, the armature comprises a central axial opening through which the valve needle extends. The electro-magnetic actuator unit comprises also a pole piece, towards which the armature is movable to take the valve needle towards the at least one opening position. In particular, the armature is operable to displace the valve needle away from the closing position when the armature is displaced towards the pole piece. The injection valve further comprises a further spring element and a magnetic ring element.

In some embodiments, the further spring element is arranged in parallel to the calibration spring and preloading a magnetic ring element. To put it differently, the calibration spring exerts a first force on the valve needle and the further calibration spring exerts a second force on the magnetic ring element, the first and second forces being directed in the same direction.

The magnetic ring element is axially movable in the cavity between a first position, in which a top side of the magnetic ring element is axially spaced apart from the pole piece and an underside of the magnetic ring element, opposite of the top side, is in contact with the valve needle, in particular when the valve needle is in the closing position, and a second position, in which a top side of the magnetic ring element is in contact with the pole piece.

In some embodiments, the magnetic ring element may be unobstructedly displaceable in reciprocating fashion between the valve needle and the pole piece. The valve needle may be shaped and arranged such that it is inoperable to block the axial travel of the magnetic ring element towards and into contact with the pole piece. In addition, the magnetic ring element may be shaped and arranged such that it is operable to transfer forces on the valve needle only in axial direction towards the closing position but in particular not in the opposite axial direction. In some embodiments, the magnetic ring element is made of magnetic material. For example, it is made of ferromagnetic steel. It may be of the same material as the armature.

Hence, the actuator unit acts on the magnetic ring element. In other words, the actuator unit is configured to displace the magnetic ring element towards the pole piece against the bias of the further spring element. By the magnetic ring element being in contact with the valve needle in its first position it is understood that the ring element can act on the valve needle, that there is a direct transfer of forces between the magnetic ring element and the valve needle. To put it differently, when the magnetic ring element is in the first position, the second force may be transferred to the valve needle by means of the magnetic ring element.

In some embodiments, when the magnetic ring element is in its first position, the further spring element may act on the needle. When it is in its second position and the armature is still at a distance from the pole piece, the further spring element does not act on the needle. To put it differently, an axial gap may be established between the valve needle and the magnetic ring element when the magnetic ring element is in the second position or between the first and second positions, depending on the axial position of the valve needle.

In some embodiments, the magnetic ring element and the electromagnetic-actuator unit are configured and arranged to move the ring element out of contact with the valve needle when the electro-magnetic actuator unit is activated to move the valve needle towards the at least one opening position.

In some embodiments, the spring load is not symmetric between opening and closing phase. The additional spring load of the further spring element may add to that of the calibration spring when it is needed, especially during a closing transient. During an opening transient, the load of the further spring element may be decoupled by means of the magnetic ring so that is does not act on the valve needle at least during a portion of the opening transient of the valve needle.

In some embodiments, the further spring element is more strongly compressed by the magnetic ring element in its second position than by the magnetic ring element in its first position. The further spring element exerts a force on the magnetic ring element opposed to the magnetic force of the actuator unit. When the actuator unit is de-energized, the further spring element expands and forces the magnetic ring element to return to its first position.

In some embodiments, the further spring element and the magnetic ring element are configured and arranged such that the magnetic ring element compresses the further spring element at least partially before an opening force of the valve assembly becomes larger than a needle closing force. In other words, the further spring element and the magnetic ring element are configured and arranged such that, when the electro-magnetic actuator unit is energized for moving the valve needle towards the at least one opening position, the magnetic ring element is displaced towards the pole piece before the opening force of the valve assembly becomes larger than the needle closing force, before the valve needle starts to move away from the closing position.

If hydraulic effects are disregarded, the force acting on the armature and needle is the sum of the force effected by the fuel pressure, the force exerted by the calibration spring, and by the further spring element when the magnetic ring element is in contact with the valve needle, and the magnetic force when the electro-magnetic actuator unit is energized for moving the valve needle. The magnetic force acts in the opening direction, the other forces in the closing direction of the valve. The "opening force of the valve assembly" may therefore be defined as the magnetic force effected on the valve needle by the electro-magnetic actuator unit and acting in the opening direction.

The "needle closing force" may be defined as the sum of the force exerted by the fuel pressure and the force exerted by the calibration spring when the valve needle is in the closing position, both forces acting in the closing direction. For avoidance of doubt, the force of the further spring element is not included in the "needle closing force" since it does not act on the valve needle once the magnetic ring element has started moving away from the valve needle. Sometimes, the terms "total needle closing force" or "total opening force" are used for the sum of all three types of forces concerned, when this sum acts in the closing and the opening direction, respectively. In order to avoid confusion, these terms are not used here.

The force acting on the magnetic ring element is the sum of the force exerted by the further spring element, which acts in the closing direction, forcing the magnetic ring element in the direction of the fluid outlet portion, and the magnetic force, which acts in the opening direction, when the electro-magnetic actuator unit is energized, forcing the magnetic ring element away from the fluid outlet portion. In some embodiments, when the electro-magnetic actuator unit is energized for moving the valve needle, the magnetic force acting on the magnetic ring element is larger than the force exerted by the further spring element, before the magnetic force acting on the armature and needle becomes larger than the sum of the force exerted by the fuel pressure and the force exerted by the calibration spring on the needle.

In some embodiments, the magnetic ring element disengages from the valve needle before the valve needle starts to open. Hence, during the opening transient, only the calibration spring preload acts on the needle, but not the further spring element preload. This can be achieved, for example, by choosing the size and/or the geometry of the magnetic ring element and/or its material. For example, given a certain magnetic material, the ring element will respond more strongly to the magnetic field if much of its material is arranged close to the pole piece. In some embodiments, the magnetic ring element is spaced apart from the armature. It may be offset towards the pole piece with respect to the armature. In addition, the response of the magnetic ring element can be modified by modifying the further spring element, in particular its length and stiffness.

In some embodiments, the further spring element is a wave spring. A wave spring has the advantage, that it can be fitted space-savingly into the valve assembly and at the same time store a comparatively large amount of energy.

In some embodiments, the pole piece comprises an upper recess, in which the further spring element is retained, and a lower recess, in which the magnetic ring element is retained, the lower recess being arranged between the upper recess and the armature. The further spring element may be arranged coaxially with the calibration spring. Thus, the further spring element may be arranged in the valve assembly without increasing the overall dimensions of the valve assembly.

The armature is axially movable with respect to the valve needle. The valve needle comprises an upper retaining element. The upper retaining element may be fixedly connected to a shaft of the valve needle which is understood to include embodiments in which the upper retaining element is in one piece with the shaft. The upper retaining element extends in radial direction and it projects beyond the shaft in radially outward direction.

In some embodiments, the upper retaining element is arranged in an axial region of the valve needle facing away from the fluid outlet portion. The upper retaining element limits the movement of the armature relative to the valve needle, in particular such that the armature is operable to engage min form-fit connection with the upper retaining element for displacing the valve needle towards the at least one opening position. In some embodiments, the underside of the magnetic ring element is configured for contacting the upper retaining element on a side of the upper retaining element facing away from the armature.

In some embodiments, the armature is spaced apart from the upper retaining element in a closed configuration of the injection valve in which the actuator unit is de-energized. For example, the valve assembly comprises an armature spring which is configured and arranged to bias the armature in axial direction away from the upper retaining element. This development complies with the free-lift concept, according to which the armature travels a free-lift gap and accumulates kinetic energy, before it engages with the valve needle to open the valve. Free-lift injectors are particularly suitable to dose high pressure fuels.

The injection valve may be a fluid injection valve. In some embodiments, the injection valve is a fuel injection valve of a vehicle. FIG. 1 shows an injection valve 1 that is suitable for dosing fuel to an internal combustion engine. The injection valve 1 comprises a valve assembly 3. The valve assembly 3 comprises a valve body 4 with a central longitudinal axis, a valve needle 11 and a calibration spring 18. The injection valve 1 further comprises housing 6 which is partially arranged around the valve body 4.

The valve body 4 comprises a cavity 9. The cavity 9 has a fluid outlet portion 7. The fluid outlet portion 7 communicates with a fluid inlet portion 5 which is provided in the valve body 4. The fluid inlet portion 5 and the fluid outlet portion 7 are positioned at opposite axial ends of the valve body 4. The cavity 9 takes in a valve needle 11. The valve needle 11 comprises a needle shaft 15 and a sealing ball 13 welded to the tip of the needle shaft 15.

In a closing position of the valve needle 11, the sealing ball 13 seals against a seat plate 17 having at least one injection nozzle. The calibration spring 18 is preloaded and exerts a force on the needle 11 in axial direction towards the closing position. The fluid outlet portion 7 is arranged near the seat plate 17. In the closing position of the valve needle 11, a fluid flow through the at least one injection nozzle is prevented. The injection nozzle may be, for example, an injection hole. However, it may also be of some other type suitable for dosing fluid.

The injection valve 1 includes an electro-magnetic actuator unit 19. The electro-magnetic actuator unit 19 comprises a coil 21 arranged inside the housing 6 and surrounding the valve body 4. Furthermore, the electro-magnetic actuator unit 19 comprises an armature 23 which is arranged in the cavity 9 and a pole piece 25 which is fixed to the valve body 4 in the cavity 9 or is in one piece with the valve body 4. The housing 6, parts of the valve body 4, the pole piece 25 and the armature 23 form a magnetic circuit.

The armature 23 is axially movable in the cavity 9 relative to the valve body 4 in reciprocating fashion. The armature 23 is also axially movable relative to the valve needle 11.

The valve needle 11 comprises an upper retaining element 24 which is fixed to the needle shaft 15. The upper retaining element 24 extends in radial outward direction from the needle shaft 15 and is arranged in an axial region of the valve needle 11 facing away from the fluid outlet portion 7. The armature 23 acts on the valve needle 11 by way of engaging in form-fit connection with the upper retaining element 24.

The upper retaining element 24 limits axial displaceability of the armature 23 relative to the valve needle 11 in axial direction towards the pole piece 25, i.e. away from the fluid outlet portion 7. In the opposite axial direction, the axial displaceability of the armature 23 relative to the valve needle 11 is limited in the present embodiment by a disc element which is fixed to the shaft 15 of the valve needle 11 at a side of the armature facing away from the upper retaining element 24. The armature 23 has an axial play between the upper retaining element 24 and the disc element.

The injection valve 1 comprises a further spring element 27 arranged in parallel to the calibration spring 18. In some embodiments, the further spring element 27 is a wave spring, which is arranged coaxially around the lower part of the calibration spring 18. The further spring element 27 preloads a magnetic ring element 28. The magnetic ring element 28 is also arranged coaxially around the lower part of the calibration spring 18 between the further spring element 27 and the upper retaining element 24.

Figure 2:
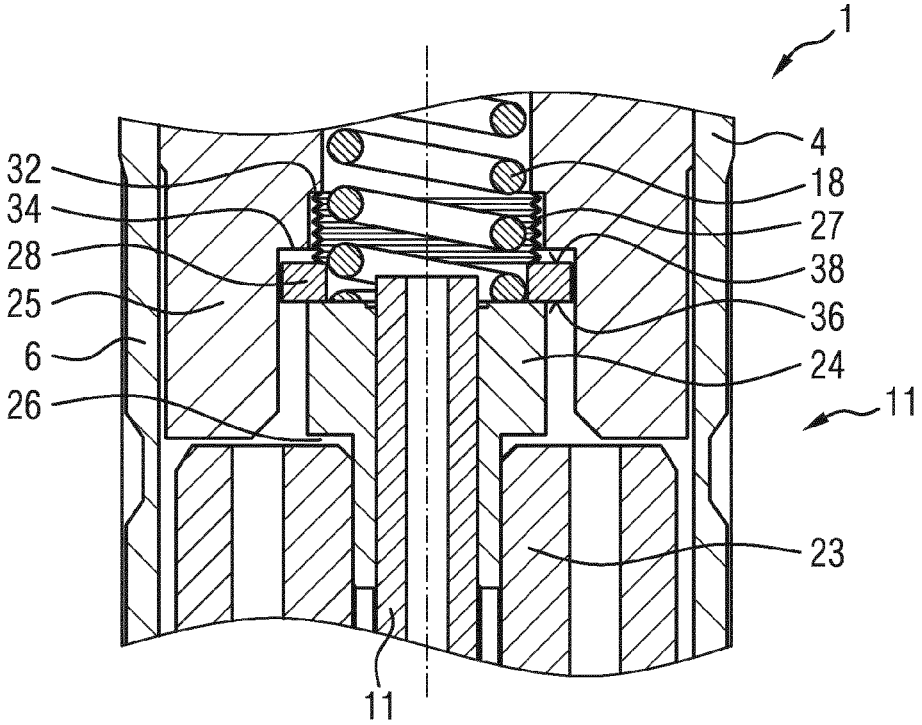
FIG. 2 shows a longitudinal section view of a detail of the injection valve according to FIG. 1 in a closed configuration.
Figure 3:
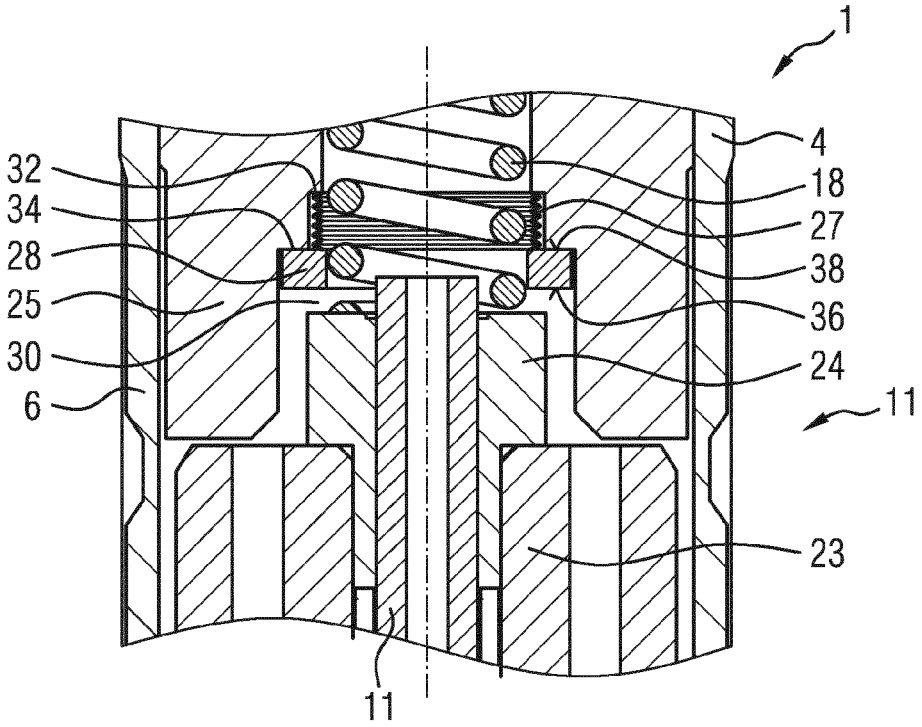
FIG. 3 shows a longitudinal section view of a detail of the injection valve according to FIG. 1 in a further configuration and FIG. 4 shows a diagram illustrating the needle lift over time during opening and closing of the valve assembly according to FIG. 1.

Details of the opening and closing process are described with reference to FIGS. 2 and 3. FIGS. 2 and 3 show longitudinal sectional views of a detail of the injection valve 1 according to FIG. 1 in a closed configuration of the valve 1 and in a further configuration of the valve 1, respectively.

In some embodiments, the further spring element 27 is retained in an upper recess 32 in the pole piece 25. The pole piece 25 further comprises a lower recess 34, in which the magnetic ring element 28 is retained. The lower recess 34 is arranged between the upper recess 32 and the armature 23. The upper recess 32 and the lower recess 34 are shaped by steps in a central through-opening of the pole piece 25 in which the calibration spring 18 is arranged.

In this closed configuration, an underside 36 of the magnetic ring element 28 is in contact with an upper side of the upper retaining element 24. The underside 36 of the magnetic ring element 28 is that side of the magnetic ring element 28, which is closest to the fuel outlet portion 7. The further spring element 27 is somewhat compressed and adds load to the closing force acting on the needle 11.

When the coil 21, which is not shown in FIGS. 2 and 3, is energized, the magnetic ring element 28 slides upwards towards the pole piece 25, thereby compressing the further spring element 27. Hence, the magnetic ring element 28 is in a second position, in which its top side 38 is in contact with the pole piece 25. The top side 38 is arranged opposed to the underside 36. A gap 30 has opened between the upper retaining element 24 and the magnetic ring element 28. This second position is shown in FIG. 3. In both configurations, the valve needle 11 is still in its closing position.

When the coil 21 is energized, the armature 23 also slides upwards, taking the needle 11 with it by way of the upper retaining element when the free-lift gap 26 is travelled, until the upper retaining element 24 re-engages with the magnetic ring element 28 and/or the armature 23 hits the pole piece 25 so that the opening movement of the valve needle 11 is stopped. This corresponds to the opened configuration of the injection valve 1. The needle lift may be equal to the gap 30.

The magnetic ring element 28 and the armature 23 are positioned on opposite axial sides of the upper retaining element 24. The magnetic ring element 28 may be arranged closer to the pole piece than the armature 23. Its position and its geometry may make experience a greater magnetic force, when the coil 21 is energized. Consequently, the magnetic ring element 28 starts moving upwards towards the pole piece 25 before the armature 23 starts moving upwards. Therefore, at the beginning of the opening transient of the needle 11, the magnetic ring element 28 is axially spaced apart from the upper retaining element 24 so that the further spring element 27 no longer adds to the force on the needle 11. FIG. 3 illustrates the situation immediately before opening of the valve 1, in which the magnetic ring element 28 has already slid upwards and the armature 23 has closed the free-lift gap 26 but in which the valve needle 11 has not yet moved upwards.

When the coil 21 is no longer energized, the armature 23 and the magnetic ring element 28 no longer experience a magnetic force pulling them towards the pole piece 25. Consequently, the armature 23 stops compensating or overcompensating the spring force of the calibration spring 18 and, additionally, the further spring element 27 presses the magnetic ring element 28 on the upper retaining element 24. Therefore, both the calibration spring 18 and the further spring element 27 add load to the needle 11 and push it down for moving the valve needle 11 towards the closing position.

Figure 4:
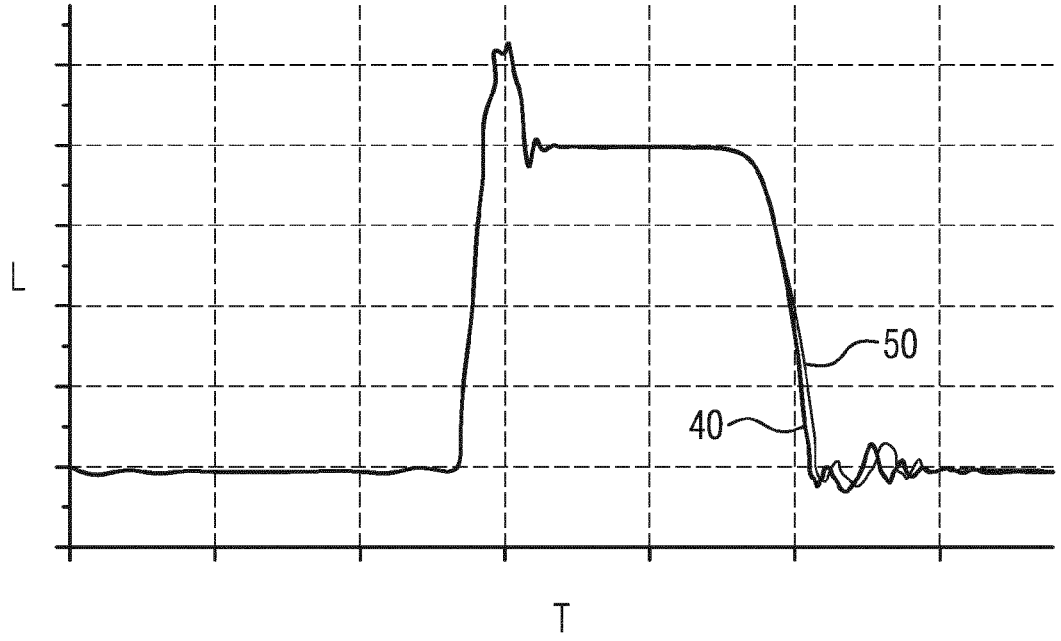

FIG. 4 shows a diagram illustrating the needle lift L over time T during opening and closing of the injection valve 1. The first graph 40 shows the needle lift in the valve 1 according to FIG. 1. The second graph 50 shows the needle lift in a conventional injection valve, which does not comprise the further spring element 27 and the magnetic ring element 28. As can be seen from FIG. 4, the valve according to the invention has a faster closing phase and a somewhat reduced post-injection amplitude. There is no difference during the opening phase of the two valve designs.

Hence, the teachings of the present disclosure provide different spring forces on the valve needle 11 during opening and closing of the valve. While the further spring element 27 adds load to that of the calibration spring 28 during closing phase, it does not add load during the opening phase.

What is claimed is:

1. An injection valve comprising:

a valve body defining a cavity with a fluid inlet portion and a fluid outlet portion;

a valve needle axially moveable in the cavity to prevent a fluid flow through the fluid outlet portion in a closed position and releasing the fluid flow through the fluid outlet portion in an open position;

a calibration spring axially biasing the valve needle towards the closed position;

an electro-magnetic actuator unit comprising an armature axially movable in the cavity with respect to the valve needle and a pole piece, wherein the armature moves toward the pole piece to take the valve needle towards the open position;

a magnetic ring axially movable within the cavity between a first position, in which a top side of the magnetic ring element is axially spaced apart from the pole piece and an underside of the magnetic ring element, opposite of the top side, is in contact with the valve needle, and a second position, in which the top side of the magnetic ring element is in contact with the pole piece; and a second spring arranged in parallel to the calibration spring to preload the magnetic ring element;

wherein the valve needle comprises an upper retaining element fixedly connected to a shaft of the valve needle, extending in radial direction, and arranged in an axial region of the valve needle facing away from the fluid outlet portion, the upper retaining element limiting movement of the armature relative to the valve needle so that the armature is operable to engage in form-fit connection with the upper retaining element for displacing the valve needle towards the open position.

2. An injection valve according to claim 1, wherein the magnetic ring and the electro-magnetic actuator unit cooperate to move the magnetic ring out of contact with the valve needle when the electro-magnetic actuator unit is activated to move the valve needle towards the open position.

3. An injection valve according to claim 1, wherein the magnetic ring is unobstructed during movement in reciprocating fashion between the valve needle and the pole piece.

4. An injection valve according to claim 1, wherein the magnetic ring is spaced apart from the armature.

5. An injection valve according to claim 1, wherein the second spring is more strongly compressed by the magnetic ring in the second position than by the magnetic ring in the first position.

6. An injection valve according to claim 1, wherein the second spring and the magnetic ring cooperate such that the magnetic ring compresses the second spring at least partially before an opening force of the valve assembly becomes larger than a needle closing force.

7. An injection valve according to claim 1, wherein the second spring comprises a wave spring.

8. An injection valve according to claim 1, wherein the pole piece comprises an upper recess retaining the second spring and a lower recess retaining the magnetic ring, the lower recess arranged between the upper recess and the armature.

9. An injection valve according to claim 1, wherein the second spring is arranged coaxially with the calibration spring.

10. An injection valve according to claim 1, wherein, when the magnetic ring is in the first position, the underside of the magnetic ring is in contact with the upper retaining element on a side of the upper retaining element facing away from the armature.

11. An injection valve according to claim 1, wherein the magnetic ring element comprises ferromagnetic steel.

* * * * *